United States Patent [19]

Gerdes et al.

[11] Patent Number: 4,726,287

[45] Date of Patent: Feb. 23, 1988

[54] WATER WASHED SUBFLOOR SYSTEM FOR PAINT SPRAY BOOTH

[75] Inventors: Donald F. Gerdes, Park Ridge; Steve E. Telchuk, Jr., Buffalo Grove, both of Ill.

[73] Assignee: Binks Manufacturing Company, Franklin Park, Ill.

[21] Appl. No.: 859,700

[22] Filed: May 5, 1986

[51] Int. Cl.[4] ..... B05B 15/12

[52] U.S. Cl. ..... 98/115.2; 55/241; 137/625.32; 261/112; 261/118

[58] Field of Search ..... 55/240, 241; 98/115.2; 118/326; 137/625.32; 251/212; 261/112, 118

[56] References Cited

U.S. PATENT DOCUMENTS

| | | | |
|---|---|---|---|
| 117,853 | 8/1871 | Allen | 137/625.32 X |
| 205,982 | 7/1878 | Stevens | 137/625.32 |
| 919,508 | 4/1909 | Williams | 137/625.32 |
| 1,185,854 | 6/1916 | Stieglitz | 137/625.32 |
| 3,138,087 | 6/1964 | Larsson et al. | 98/115.2 |
| 3,500,741 | 3/1970 | Bok | 98/115.2 |
| 3,884,654 | 5/1974 | De Crevoisier et al. | 98/115.2 X |
| 4,222,319 | 9/1980 | Donahue | 98/115.2 |
| 4,612,025 | 9/1986 | Sampey | 98/115.2 X |
| 4,643,082 | 2/1987 | Lynham et al. | 98/115.2 |

*Primary Examiner*—Harold Joyce

*Attorney, Agent, or Firm*—Juettner Pyle Lloyd & Verbeck

[57] ABSTRACT

A paint spray booth water washed subfloor system, including distribution piping for supplying water to only one portion thereof. The distribution piping has only one main pipe to supply water to the one portion of the subfloor. The water supplied to the one portion of the subfloor is then transferred from that portion through a trough extending across and forming part of the subfloor to provide water to the other portions of the subfloor. Preferably, at least a part of the subfloor's other portions are sloped downwardly from both sides toward a center slot or opening for generating a fall of water to mix with paint overspray laden air descending through the center opening. The distribution piping is provided with special valves for throttling the flow of water onto the subfloor, but yet permitting maximum flow, and assisting the flow of water into the trough portion, and hence, to the other portions of the subfloor. Following the principles of the invention, a spray booth subfloor of any desired length can be constructed, simply by adding a number of similar sections or modules together to achieve the desired length.

21 Claims, 7 Drawing Figures

WATER WASHED SUBFLOOR SYSTEM FOR PAINT SPRAY BOOTH

This invention relates to a paint spray booth subfloor construction and its water distribution piping, and more particularly to a water washed subfloor initially supplied with water from but a single main supply pipe.

BRIEF DESCRIPTION OF THE PRIOR ART

Prior art sloped subfloors for paint spray booths providing a flow of moving liquid thereover are shown in U.S. Pat. Nos. 3,168,030 and 4,299,602. Prior art subfloors providing a flooded pool in a pan are shown in U.S. Pat. Nos. 4,222,319, 4,279,196 and 4,285,270. While the foregoing patents show prior art booths with the washing sections below the subfloor, such subfloors may also be used in booths with washing sections at the side thereof, as shown in U.S. Pat. Nos. 3,168,030 (sloped type subfloor) and 3,391,630 and 3,807,281 (flooded pan type subfloors).

With respect to the flooded pan type subfloor, achieving a uniform water distribution over the subfloor was not a problem, provided the water depth permitted in the pan was deep enough. In fact, if the depth was deep enough, a single water outlet could supply all the water to the pan. However, such construction has disadvantages in that a deep pan containing a great depth of water is exceedingly heavy. Since this great weight had to be supported, this resulted in the need for increased structural strength and increased costs. Further, the paint overspray eventually accumulated in the flat pan to a point it disturbed the water distribution and required cleaning, adding to operating expenses.

The sloped subfloor eliminated these disadvantages by greatly reducing the weight of the water on the subfloor and also, due to the water's movement, providing a self-cleaning effect. However, for the sloped floor to be successful, there must be uniform water distribution to the subfloor, and this can be difficult to achieve.

If uniform water distribution were the only factor that had to be considered, it might be more simple to achieve. However, it is not. Among the many matters that must be considered in the construction and operation of a paint spray booth are the initial fabrication and installation costs and the operating or maintenance costs. Generally, compromises have to be made in favor of some of the elements making up these two factors as it is difficult to lower initial installation costs, while at the same time decreasing operating costs. One item which effects maintenance costs is the type of subfloor installed, and the necessary water distribution system used with the subfloor. In order to reduce maintenance costs and keep operating efficiency high, it is essential that the water be uniformly distributed to the subfloor; this being particularly important for the sloped type subfloor. If water is not uniformly distributed, some areas are washed with water, while other areas remain barren with consequent inefficiency of the air washer and undesirable accumulation of paint overspray.

Generally, the desired uniform water distribution for the subfloor has been achieved by providing complicated and expensive distribution piping, having a main supply pipe extending along each side of the spray booth. Such a prior art booth is shown in FIG. 1. The booth has a grill floor 10 beneath the spray painting chamber (not shown) on which work men and/or other personnel may stand for spray painting or servicing of automatic painting equipment. As the floor is fenestrated, air laden with paint overspray descends through the grill floor under the influence of a known air exhaust system. A subfloor 12 is provided beneath the grill floor and is washed or flooded with water to remove the overspray. The subfloor 12 has on each side a water distribution weir 14 extending generally parallel to and along the length of each side of the booth. The inner edges 16 of the sloped subfloor terminate in a center slot or opening 18, which extends generally along the center of the booth for substantially its full length, through which the paint laden air is exhausted.

As shown, each side of the prior art subfloor is provided with its own main water supply pipe 20, which extends parallel to and throughout the entire length of the booth. A plurality of generally vertical risers 22 on each pipe 20 supply water at spaced intervals to the respective distribution weir 14. As is apparent, each pipe 20 and its risers provided water only to the respective weir and subfloor side, because the water from the one side could flow only from its weir into the center slot. Thus, it was necessary to provide a separate main water supply for each side of the booth. While this prior art subfloor and water distribution system has worked extremely well, they are relatively complicated and expensive to construct.

SUMMARY OF THE PRESENT INVENTION

The present invention eliminates the foregoing disadvantages, and achieves lower installation costs with a uniform water distribution and high operating efficiency, without increased maintenance costs.

The subfloor and water distribution system of the present invention comprises a water washed subfloor having a center opening or slot therein at the bottom of a pair of sloped sides, water distribution piping having but a single main supply pipe running the length of the subfloor for admitting water to the subfloor, and means in the form of one or more cross troughs for distributing water from the point of admission to all other portions of the subfloor. With this construction, uniform water flow over the entire subfloor and into said center opening is achieved.

According to the invention, the two side margins of the subfloor and the cross trough or troughs bridging between the two sides function as a flooded subfloor to which water is supplied from the single main, and weirs between the side margins and the sloping portions of the subfloor serve to distribute water from the side margins uniformly over the sloping portions and into the center slot. With the subfloor and water distribution system of the present invention, costs are greatly reduced and construction simplified.

The system further includes a special water volume control valve which is fitted to the end of each riser in the distribution piping system. The volume control valve has a pair of control elements, preferably cone-shaped inside the riser which interact to throttle or control the flow of water from the riser. The volume control valve has adjusting means for placing and holding the control elements in various relative positions to regulate the flow through the riser. Further, the upper portion of the valve, which supports it on the subfloor, is formed to assist and direct the flow of water from the riser in various directions to help provide the desired uniform water distribution.

It is a primary object of the present invention to provide a paint spray booth subfloor which has water admitted from only one main supply pipe, but yet has uniform water flow over the subfloor.

Another object of the present invention is to provide a subfloor with water distribution piping to only one side of the subfloor, with all other portions being supplied with water from the one side of the subfloor.

Still another object of the present invention is to provide a sloped type subfloor having a center slot with a high cleaning efficiency and a cross trough portion providing a flow of water thereto.

A further object of the present invention is to provide volume control for the water distribution piping which permits maximum water flow and assists in uniformly distributing the water to the subfloor.

These and other objects of the present invention will become apparent from the accompanying drawings and the following detailed description.

DESCRIPTION OF THE PREFERRED EMBODIMENTS

Figure 2:
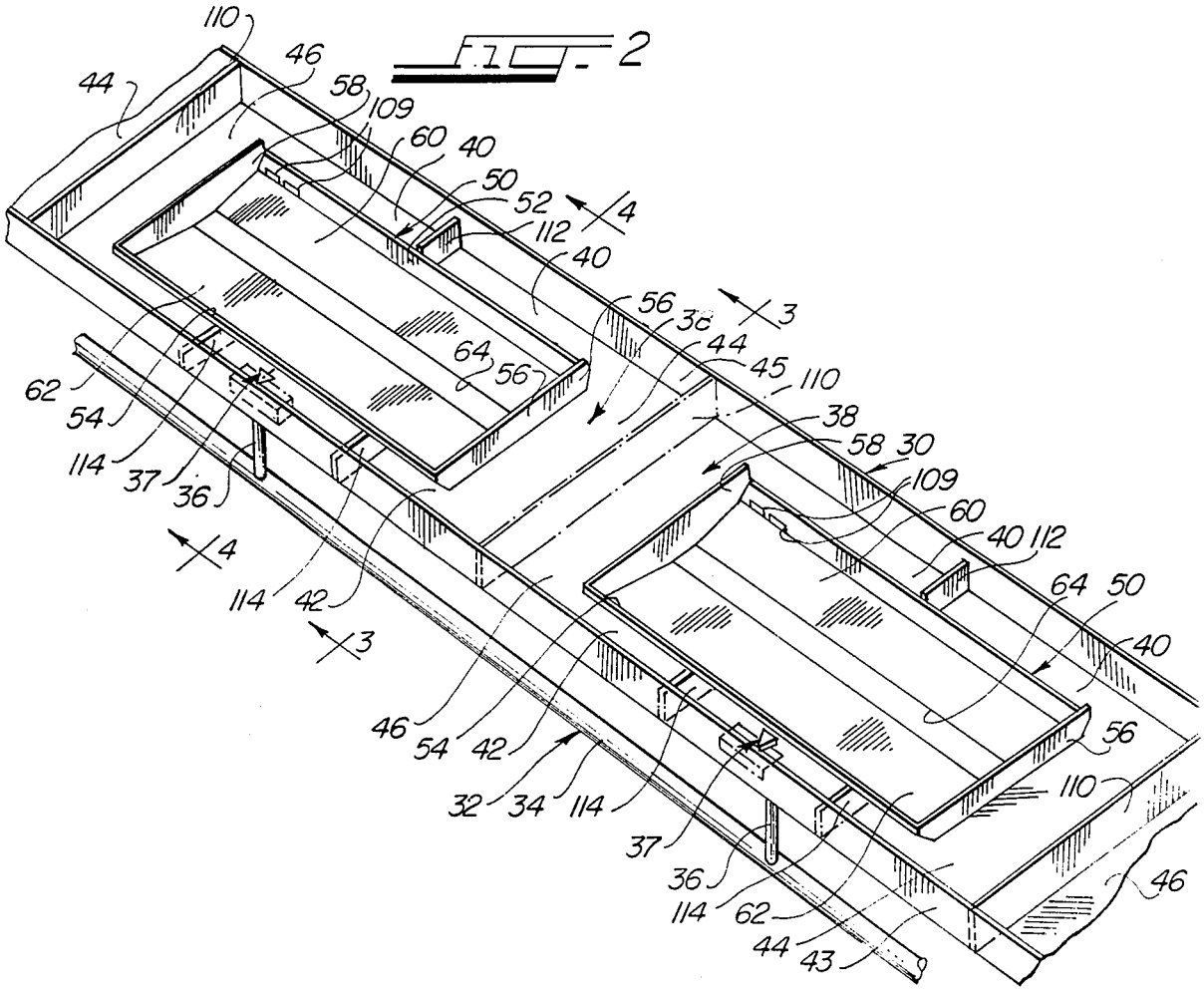
FIG. 2 is a perspective view of a first embodiment of the paint spray booth subfloor and water distribution system of the present invention.
Figure 3:
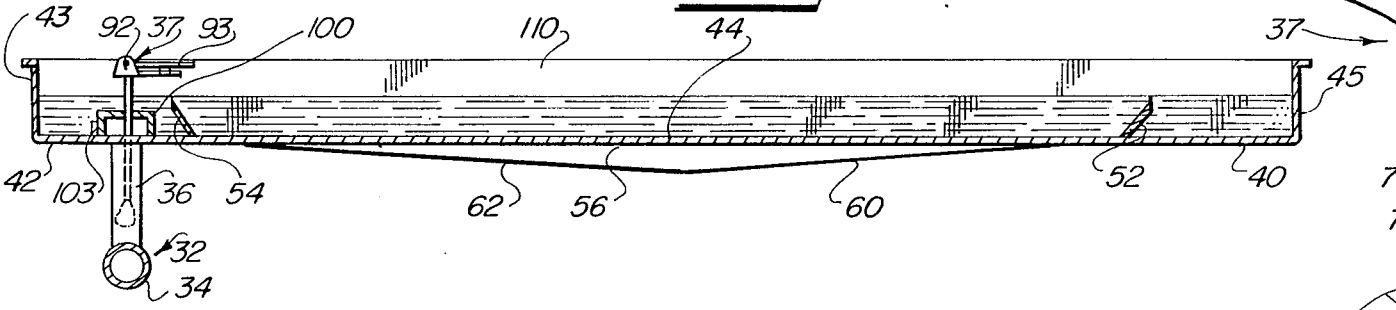
FIG. 3 is a cross-sectional view taken along 3—3 of FIG. 2.
Figure 4:
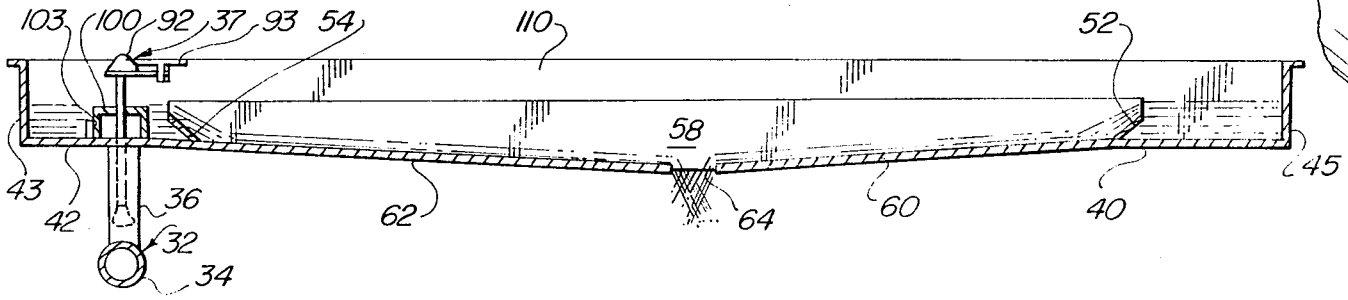
FIG. 4 is a cross-sectional view taken along 4—4 of FIG. 2.

Referring to FIGS. 2 to 4, a first embodiment of the subfloor and water distribution system of the present invention is shown as including a water washed subfloor 30 and water distribution piping 32 having but a single main supply pipe 34. While not shown, it should be understood that, like the prior art, the subfloor 30 is provided beneath the grill floor and spray painting chamber of the booth, and means are provided to draw the overspray laden air downwardly through the grill toward and through the subfloor.

In the first embodiment of the present invention, the main water supply pipe 34 extends along only one side of the subfloor 30. Water from the pipe 34 is supplied through generally vertical risers 36, which contain volume control valves 37 more fully illustrated in FIG. 5, to openings in the subfloor 30 at spaced intervals. This spacing is determined by the size of the booth and generally is in the range of about 15 to 40 feet.

The subfloor 30, itself, comprises a generally horizontal or flat portion 38 which has two side areas 40 and 42 and front and rear areas 44 and 46, respectively. The flat portion 38 of the subfloor is contained by side walls 43 and 45. A large opening 48 is provided in the center of the flat portion 38.

Figure 1:
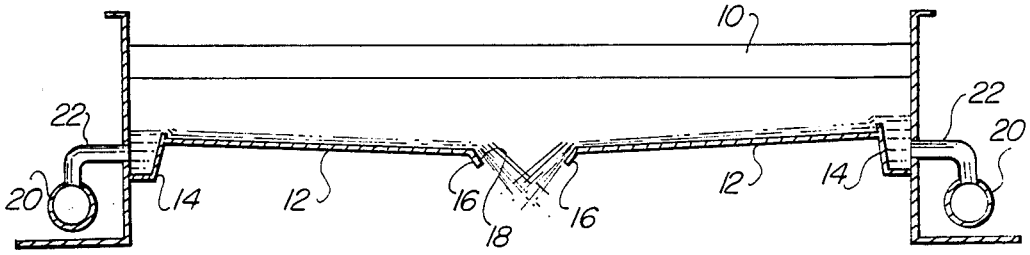
FIG. 1 PRIOR ART
FIG. 1 is a cross-sectional view of a prior art subfloor for paint spray booths of the downdraft type showing the two main water supply pipes.

In this large opening 48 a rectangular weir structure 50 is provided, and comprises angularly inclined side weirs 52 and 54 (see FIG. 4), for permitting the flow of water thereover. These side weirs 52 and 54 are joined at their respective ends by generally vertical flat sheets, forming a front closure 56 and a rear closure 58. The closures 56 and 58 are of a greater vertical height than the side weirs 52 and 54 (say nine inches compared to eight inches) to prevent water from flowing over the closures. The lower edges of closures 56 and 58 are inclined downwardly toward their centers. A pair of downwardly extending or sloping panels 60 and 62 are connected to the bottom edges of the side weirs 52 and 54 and the closures 56 and 58. Orifice means, in this instance, a center slot or opening 64 is provided between the inner, lower edges of the sloped panels 60 and 62. The discharge orifice or opening 64 functions in a manner similar to that of the prior art opening 18 (FIG. 1), and the panels 60 and 62 function in a manner similar to the sloped panels 12 of the prior art subfloor (FIG. 1). Overspray laden air from the spray painting chamber is drawn downwardly through the slot 64 and is there mixed with the water flowing downwardly into the slot to aid in removing the overspray from the air.

If desired, a subfloor can be made up of several of the sections described above to provide a booth of any desired length, e.g., two such sections as shown in FIG. 2, the respective fronts and rears of the adjoining sections being arranged adjacent each other.

Figure 5:
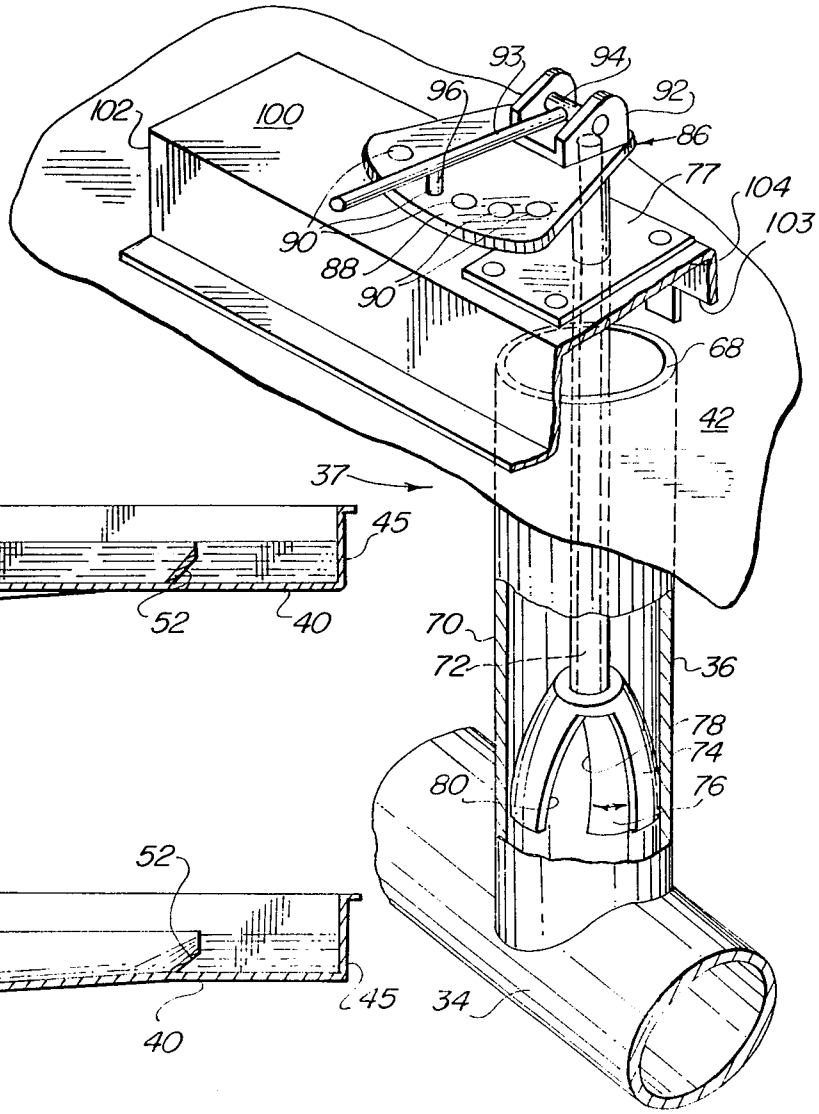
FIG. 5 is an enlarged, perspective view of the water volume control valve shown in FIG. 2, with portions thereof broken away to better illustrate its construction.

As shown in FIG. 5, the riser supplying water to the subfloor extends through the side area 42 of the flat portion 38, the top 68 of the riser 36 being sealed in a known manner to the floor. Unless appropriately controlled, water would spout from the riser 36. In order to control the flow, each riser 36 is provided with a volume control valve 37 which can be conveniently adjusted from above. Each valve 37 has a pair of elongated, vertical members, the first in the form of a stationary tubular member 70 of an outer diameter significantly smaller than the riser and a second cylindrical member or rod 72, of yet a smaller diameter, which extends through and is rotatable within the tubular member 70. The upper and lower ends of member 72 extend beyond the ends of the tube 70. Flow control is carried out by a pair of cone shaped elements 74 and 76 which fit well within the riser 36. Preferably, the elements 72 and 74 are cone shaped. The cone 74 is attached to the tube 70 which is stationary, the tube being secured as by welding to a mounting plate 77. The cone 76 is attached to and rotates with member 72. The cones 74 and 76 each have openings 78 and 80 of an area substantially that of the internal cross-sectional area of the riser. Thus to permit water flow therethrough, the openings 78 and 80 are aligned, and to reduce the flow they are misaligned. By using cones 74 and 76 which have openings of increased area (compared to openings that could be provided in flat discs fitting within the risers), when the openings are aligned the valve can flow water at or near the capacity of the riser (and at a much greater capacity than if say flat discs were used). Also, the risers 36 may be of a smaller diameter if cone shaped elements are used, instead of flat discs, for the same flow.

Movement of the member 72, and of cone 76 and its opening 78, relative to the member 70, and cone 74 and its opening 78, is controlled from above the subfloor by an adjustment mechanism 86. This mechanism comprises a retaining plate 88 having a series of position openings 90 provided therein, the plate 88 being secured to the top of tube member 70 as by welding. The upper end of the member 72 carries and is secured to a generally U-shaped bracket 92. The bracket 92 carries a pivotable handle 93 which rotates on a pivot pin 94 engaging in a pair of openings in the bracket 92. The handle 93 has a locating pin 96 which can be engaged in any of the position openings 90 in the retainer plate 88 merely by pivoting the handle 93 downwardly and which can be disengaged from a respective opening 90 merely by pivoting the handle upwardly.

When the handle is pivoted upwardly to disengage the pin 96 from the retainer plate 88, the handle can be swung from side to side to rotate the inner cone 76 relative to the stationary outer cone 74, thereby to vary the size of the openings 78–80 and control the volume of flow of water through the valve and the riser to the subfloor. Thus, the valve can be adjusted, and locked in a selected adjusted position by the pin 96, to set the valve in any desired position between full open and substantially fully closed to control the flow of water through each riser as desired.

The valve 37 not only controls the volume of flow, but also helps channel the water in the desired direction or directions to aid in achieving the desired uniform flow. As is shown, the adjustment mechanism 86 for valve 37 is secured to the mounting plate 77 which is removably mounted, as by bolts, to a channel member 100 secured to the flat portion 38 of the floor. The channel member 100 directs the flow of water from the riser in the desired direction or directions. In the illustrated example, the channel member 100 is open at its opposite ends 102 and 104 and at its outer side 103. Thus, water can flow from channel 100 toward the front and rear of side portion 42 of the floor and toward the sidewall 43, while water is inhibited from directly gushing over side weir 54. If desired, the channel could be arranged to be open in one or more different directions to encourage flow in any desired direction and/or to inhibit water flow in certain directions to help achieve uniform flow.

In the preferred embodiment, the entire valve mechanism is carried by the mounting plate 77 and the latter is removably mounted on the channel 100 to facilitate removal of the valve from the riser for maintenance purposes, should such ever be necessary.

Referring now to FIGS. 2, 3 and 4, the water from each valve 37 and its channel 100 flows along the side area 42 toward the front 44 and rear 46 of the subfloor. Some of the water also flows out the open outer side 103 of the channel 100 toward the side wall 43. Due to the fact that the weirs 52 and 54 and the closures 56 and 58 extend above the flat portion 38 of the floor, and that the water is distributed uniformly from the channel 100 and does not spout or spew out of the riser, the water is distributed uniformly over the two side portions 40 and 42 and the front and rear areas 44 and 46 of the floor until the water reaches the level of the tops of the two weirs and down the inclined slope plates 60 and 62 and into the center slot 64.

In contrast to prior art subfloors of the type shown in FIG. 1, wherein there was an essentially continuous longitudinal slot 18, the subfloor of the invention provides one or more relatively short slots spaced apart by cross troughs formed by the front and rear areas 44 and 46 of the flat portion 38 of the floor. These cross troughs establish communication between the two sides of the subfloor and in conjunction with the relative elevations of the end closures 56 and 58 and the weirs 52 and 54 permit the use of only a single water supply main 34. This in turn provides a concomitant reduction (by at least one-half) in the number of risers, valves, piping and pumps required for the system. Consequently, utilization of the invention results in significantly lower initial costs of construction, shipping and installation, and also lower operating costs. Further, as less water is utilized in the system, the piping sizes, sludge system and treatment chemicals needed, are reduced.

In addition, by virtue of utilization of a plurality of relatively short slots, close manufacturing tolerances for the weirs 52 and 54 and the air scrubber slot 64 can more readily be maintained, thereby to insure a highly uniform and efficient flow of water over the slope plates 60 and 62 and into the scrubber slot 64.

The dimensions of the flat areas 40, 42, 44 and 46 of the subfloor are selected to assure an adequate supply of water to both weirs with sufficient velocity of flow within said areas to prevent accumulation of paint overspray therein and to insure the desired self-cleaning action. However, the dimensions are also selected so that the water reaching the top of the weirs is relatively quiescent and non-turbulent, and will overflow each weir as a continuous, uninterrupted, smooth sheet.

To prevent the existence of any stagnant body of water in the system, and also to insure complete draining of the system when not in use, the weirs 52 and 54 are provided with relatively small interrupted drain slots 109 (FIG. 2) at their lower edges through which water can drain out of the entire flat portion 38 of the subfloor.

If desired or necessary, full width baffles 110 can be provided between adjacent sections to keep the flow uniform within each section, particularly where the booth is quite long and sections thereof may be at somewhat different elevations. Likewise, a short baffle 112 could be installed on the side of the subfloor opposite the riser 36, and its position could be varied until a balanced flow is achieved. Though unlikely, should it be necessary, short baffles 114, like baffles 112, could also be installed on the riser side of the subfloor 42 to help balance out the flow.

Figures 6, 7:
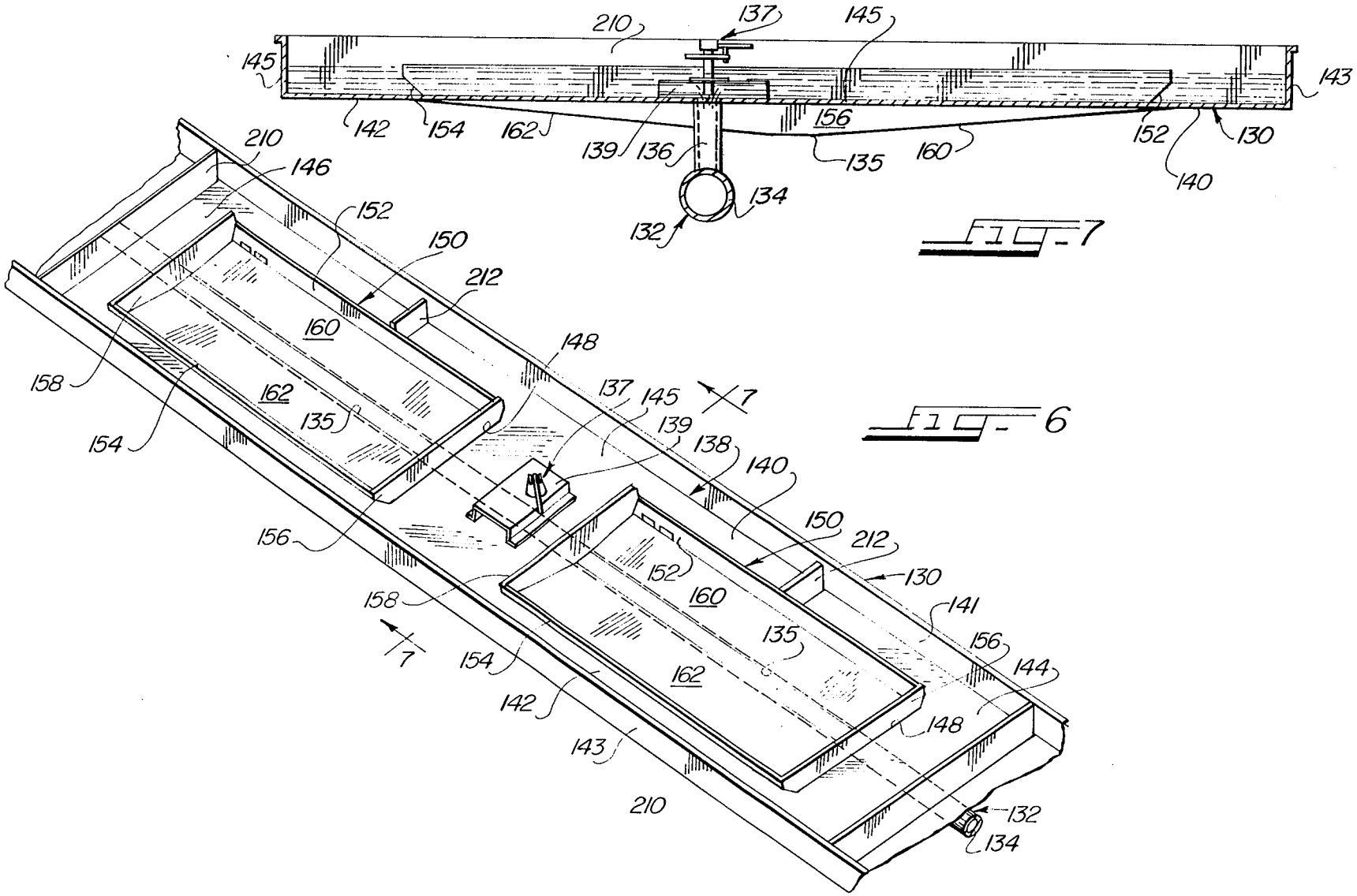
FIG. 6 is a perspective view of a second embodiment of the paint spray booth subfloor and water distribution piping system of the present invention.
FIG. 7 is a cross-sectional view taken along line 7—7 of FIG. 6.

A second embodiment of the present invention is illustrated in FIGS. 6 and 7. The second embodiment is similar to the first, the principal difference being that the single main supply pipe is now more centered and its risers and valves intersect near the center of a cross trough, rather than at one side of the booth. While not shown, it should be understood that the illustrated embodiment is provided beneath the spray painting chamber and grill floor of a paint spray booth, and that means are provided to draw the overspray laden air downwardly through the subfloor.

In more detail, the second embodiment has a water-washed subfloor 130 and a water distribution piping system 132 having but a single main supply pipe 134. The main water supply pipe 134 extends generally parallel to the center of the subfloor 130, but set off to one side of the air scrubber slot or discharge orifice means 135. Water from the pipe 134 is supplied to generally vertical risers 136 and then through volume control valves 137, similar to valves 37, to the subfloor 130.

The subfloor 130 comprises a generally flat structural floor 138 which has two side areas 140 and 142, a front area 144, a center area 145 and a rear area 146, each side area 140 and 142 of the subfloor being contained within and defined by side walls 141 and 143, respectively. A pair of large, longitudinally spaced openings 148 are provided in the flat center of the floor 138.

In each large opening 148 a rectangular weir structure 150 is provided. Each weir structure 150 comprises a pair of inclined side weirs 152 and 154, for permitting the flow of water thereover. Each pair of these side weirs 152 and 154 are joined at their ends by vertical flat sheets, forming a front closure 156 and a rear closure 158. A pair of downwardly sloping panels 160 and 162 are connected to the bottom edges of each of the closures 156 and 158 and define therebetween the air scrubber or slot opening 135.

If desired, a subfloor made up of several units as described above can be joined to provide a subfloor of any desired length, with the respective rear of one section adjoining the front of the next section.

The riser 136 for supplying water to the subfloor extends through the center cross trough 145 of the flat floor 138. To control flow therethrough, the riser 136 is provided with a volume control valve 137. The valve 137 also includes a channel 139 extending widthwise of the floor and open at its ends to channel the water in directions toward the respective sides 140 and 142 to achieve the desired uniform flow.

If desired or necessary, full width baffles 210 can be provided between one or more sections to help keep the flow uniform. Likewise, a short baffle 212 could be installed at the side, and its position varied until the flow is balanced.

In use and operation, the subfloor 130 of the second embodiment functions the same as, and in essence is the same as, the subfloor 30 of the first embodiment. The only difference is that the water main is located adjacent the center of the subfloor and two air scrubber sections 150 are supplied with water from a single riser 136, thereby to provide still further economies in construction, installation and operating costs.

In both embodiments, the utilization of relatively short spaced slots interrupted by cross troughs permits the use of a single water main and provides a concomitant reduction in risers, valves and pumps. Also, the short slots provide for a highly effective and efficient air scrubbing action and for highly uniform flow of the air scrubbing liquid into the scrubber.

While the foregoing description refers to water as the scrubbing medium, it is to be understood that the medium may include liquids other than water that are suitable for use in paint spray booths, such as oil and/or water or other liquids treated with suitable additives. It should be further understood that control elements other than cone shaped, such as flat discs, could be used in the volume control valve.

While two preferred embodiments of the present invention have been illustrated and described, it is to be appreciated that variations, additions and modifications may be made therein without departing from the scope of the appended claims.

What is claimed is:

1. A water washed subfloor system for a paint spray booth or the like, comprising a subfloor having two sides with a downwardly sloped panel on each of said sides, discharge orifice means in said subfloor at the lower edges of and between said two sloped panels, a single main water distribution pipe adjacent the subfloor for delivering water to said subfloor, means in said subfloor for distributing water from said main pipe to both of said sides of said subfloor, and means for flowing water uniformly from each of said sides onto said sloped panels and into said orifice means, whereby water admitted from said single main water distribution pipe flows therefrom to said means in said subfloor for distributing the water to both of said sides of said subfloor, uniformly across said sloped panels of said subfloor, and into said orifice means, and said orifice means receives water from both sides of the subfloor, though water is admitted only from said single main distribution pipe.

2. A subfloor system as in claim 1, wherein said sloped panels extend downwardly from said sides toward said orifice means for only a portion of the length of said subfloor.

3. A subfloor system as in claim 2, wherein said means for distributing the water to both sides is adjacent to said sloped panels and extends between said sides.

4. A subfloor system as in claim 1, wherein said means for distributing the water to both sides comprises a cross trough extending between and communicating with both sides of said subfloor.

5. A subfloor system as in claim 4, comprising a plurality of sections each as described in claim 4, each section having at least one cross trough.

6. A subfloor system as in claim 4, wherein said trough is of a cross-sectional area sufficiently large to provide adequate water flow to said sides, but sufficiently small to maintain adequate water velocity in said trough to prevent substantial accumulation of overspray in said trough.

7. A subfloor system as in claim 4, wherein said single main water distribution pipe runs generally parallel to one side of said subfloor, and includes at least one riser for supplying water from said single main water distribution pipe to said one side of said subfloor, said cross trough delivering water from said one side to the other side of said subfloor for uniform distribution over both of said downwardly sloped panels.

8. A subfloor system as in claim 4, wherein said single main water distribution pipe runs generally parallel to the center line of said subfloor, and includes at least one riser for supplying water from said single main water distribution pipe to said cross trough, said cross trough simultaneously delivering water to both sides of said subfloor for uniform distribution over both of said downwardly sloped panels.

9. a subfloor system as in claim 1, wherein said single main water distribution pipe extends generally horizontally below said subfloor, and at least one riser extends generally vertically upward from said pipe through said subfloor for delivering water to the subfloor.

10. A subfloor system as in claim 9, further comprising a volume control valve for each riser.

11. A subfloor system as in claim 10, wherein said volume control valve comprises a pair of relatively movable control elements for regulating the flow of water through said valve, each of said control elements having openings therein alignable with each other for forming an open position and alternatively partially misalignable with each other for forming at least one partially open position.

12. A subfloor system as in claim 11, wherein said control elements are cone-shaped, the area of said openings in said cone-shaped elements being approximately equal to the area of the internal cross section of said riser, whereby said volume control valve when in the open position does not unduly restrict water flow through said riser.

13. A subfloor system as in claim 10, wherein each volume control valve further comprises channel means for diverting the flow of water in one or more directions for encouraging uniform water distribution.

14. A subfloor system as in claim 1, further comprising drainage means for draining the water from said subfloor onto at least one said sloped panels.

15. A subfloor system for a paint spray booth or the like, comprising a subfloor, a main water distribution pipe, at least one riser extending from said main water distribution pipe to and communicating with said subfloor, and a volume control valve in each riser, said volume control valve comprising a pair of relatively movable cone-shaped elements for regulating the flow of water through said valve, each of said cone-shaped elements having openings therein alignable with each other for forming an open position and alternatively misalignable with each other for forming at least one partially open position, said openings in said cone-shaped elements being approximately the area of the internal cross section of said riser, and an adjustment mechanism for said control valve extending from said cone-shaped elements through said riser to above said subfloor, said adjustment mechanism altering the relative position of said cone-shaped elements to one another and being adjustable from above said subfloor, whereby said volume control valve when in the open position does not unduly restrict water flow through said riser and can be readily adjusted to balance the flow onto said subfloor from said subfloor.

16. A subfloor system as in claim 15, wherein said valve is located at the top of the riser, and further comprises channel means mounted on said subfloor for diverting the flow of water into one or more directions for encouraging uniform water distribution over said subfloor.

17. A water-washed subfloor system for a paint spray booth or the like, comprising a subfloor having a substantially flat portion including spaced side areas and at least one cross trough extending between and interconnecting said side areas, a weir extending upwardly from said flat portion at the inner edge of each of said side areas, a downwardly sloped panel extending inwardly and downwardly from each of said weirs, said panels forming a discharge orifice at their inner lower ends, a closure member extending upwardly from said flat portion along the edges of said cross trough between said weirs, said weirs extending upwardly to essentially the same level and said closure members extending upwardly to a higher level than said weirs, a water supply main extending adjacent said subfloor and communicating with said flat portion thereof for delivering water thereto, said weirs and said closure members causing the water to accumulate uniformly over said flat portion of said subfloor to the level of said weirs and causing the water to be delivered to and uniformly distributed over said weirs and onto said sloped panels for uniformly distributed descent over said sloped panels and into said discharge orifice.

18. A subfloor system as in claim 17, including a pair of said cross troughs and a pair of said closure members, one at each end of said sloped panels extending between the respective ends of said weirs.

19. A subfloor system as in claim 17, wherein said cross trough extends between said side areas generally centrally of said side areas, and pairs of weirs, sloped panels and closure members are provided at each side of said cross trough.

20. A subfloor system as in claim 19, including three of said cross troughs, one at each end of said side areas and one extending between said side areas generally centrally thereof.

21. A subfloor system as in claim 17, including orifice means in the lower edge portions of at least one of said weirs for accommodating draining of said flat portion of said subfloor.

* * * * *